US006754958B2

(12) United States Patent
Haws et al.

(10) Patent No.: US 6,754,958 B2
(45) Date of Patent: Jun. 29, 2004

(54) APPLYING FLUID PREPARATIONS TO THE SKIN, E.G. IN CONNECTION WITH SHAVING

(75) Inventors: Christopher Martin Haws, Streatley-on-Thames (GB); Stephen Paul Hazell, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/771,122

(22) Filed: Jan. 26, 2001

(65) Prior Publication Data

US 2002/0029478 A1 Mar. 14, 2002

Related U.S. Application Data

(63) Continuation of application No. PCT/US99/18541, filed on Aug. 13, 1999.

(30) Foreign Application Priority Data

Aug. 19, 1998 (GB) ..... 9818115

(51) Int. Cl.[7] ..... B26B 19/40
(52) U.S. Cl. ..... 30/41; 30/535; 222/399
(58) Field of Search ..... 30/41, 41.5, 535, 30/538, 125; 222/399; 239/373

(56) References Cited

U.S. PATENT DOCUMENTS

| | | | | | |
|---|---|---|---|---|---|
| 1,836,800 | A | * | 12/1931 | Hope | 30/41 |
| 1,892,836 | A | * | 1/1933 | Harvey | 30/41 |
| 1,899,841 | A | * | 2/1933 | Acken | 30/41 |
| 2,131,498 | A | * | 9/1938 | Chandler | 30/41 |
| 2,327,192 | A | * | 8/1943 | Keene | 30/41 |
| 2,888,173 | A | * | 5/1959 | Wolcott | 222/183 |
| 3,053,422 | A | | 9/1962 | Tenison et al. | 222/399 |
| 3,353,264 | A | * | 11/1967 | Waldman | 30/41 |
| 3,417,468 | A | * | 12/1968 | Miyauchi | 30/41 |
| 3,726,009 | A | * | 4/1973 | Hackmyer | 222/402.11 |
| 3,743,085 | A | | 7/1973 | Richert | 206/42 |
| 3,858,764 | A | * | 1/1975 | Watson | 222/399 |
| 3,964,649 | A | * | 6/1976 | Alexander | 222/399 |
| 4,074,429 | A | | 2/1978 | Roberts | 30/41 |
| 4,238,882 | A | | 12/1980 | Harrison, Sr. | 30/41 |
| 4,377,034 | A | * | 3/1983 | Druash et al. | 30/41 |
| 4,492,025 | A | | 1/1985 | Jacobson | 30/87 |
| 4,809,432 | A | * | 3/1989 | Schauble | 222/494 |
| 5,022,564 | A | * | 6/1991 | Reyner | 222/386.5 |
| 5,113,585 | A | | 5/1992 | Rogers et al. | 30/41 |
| 5,234,140 | A | | 8/1993 | Demarest et al. | 222/394 |
| 5,337,478 | A | * | 8/1994 | Cohen et al. | 30/41 |
| 5,673,485 | A | * | 10/1997 | Hill | 30/41.5 |
| 5,855,066 | A | * | 1/1999 | Manger | 30/41 |
| 6,241,164 | B1 | * | 6/2001 | Wolfe | 239/303 |

FOREIGN PATENT DOCUMENTS

| | | |
|---|---|---|
| DE | 4335449 | 4/1994 |
| EP | 0505630 | 9/1992 |
| GB | 690828 | 4/1953 |
| GB | 2075406 | 11/1981 |
| GB | 2266854 | 11/1993 |
| WO | 9602369 | 2/1996 |
| WO | 9717174 | 5/1997 |
| WO | 9718065 | 5/1997 |

* cited by examiner

*Primary Examiner*—Kenneth E. Peterson
(74) *Attorney, Agent, or Firm*—Charles P. Boukus, Jr.; Donal B. Tobin

(57) ABSTRACT

A safety razor has a handle formed by a refillable container (8). After filling with water a tablet (20) containing a carbon dioxide gas generating substance is added to the water and the gas pressure is used to deliver liquid from the container to the underside of the razor blade unit (1). The tablet also includes a substance which upon being mixed with water produces a fluid which may have desirable properties for application to the skin during shaving, such as lubrication, moisturizing, applying a fragrance, chemical treatment of hairs, bacterial or medicinal treatment of the skin and/or blood coagulation. The container (8) can be equipped with a dispenser (30) operable to deliver tablets into the water filled container.

20 Claims, 8 Drawing Sheets

APPLYING FLUID PREPARATIONS TO THE SKIN, E.G. IN CONNECTION WITH SHAVING

THIS APPLICATION IS A CONTINUATION OF Ser. No. PCT/U.S. 99/18541 FILED Aug. 13, 1999

This invention relates to the field of preparing fluids for application to the skin such as in connection with shaving and particularly so-called "wet shaving" during the process of which a razor with one or more sharpened cutting edges is moved over the skin to sever hairs projecting from the skin. It is usual to apply to the skin a preparation, such as shaving soap, which can be applied by means of a brush, shaving foam, or shaving gel to improve the conditions for actual shaving. The need to prepare the skin in this way as part of the overall shaving procedure is an inconvenience and adds significantly to the time required to complete a satisfactory shave.

With the foregoing drawbacks in mind, in accordance with an aspect of the present invention there is provided a method of preparing a fluid to be applied to the skin, for example in connection with a shaving procedure, comprising filling a refillable reservoir with water and adding to the water a substance which generates gas and which produces said fluid upon mixing with water, sealing the reservoir after addition of the substance whereby the gas generated pressurizes the interior of the reservoir for delivering the fluid from the reservoir for application to the skin.

According to another aspect the invention provides a system for preparing a fluid to be applied to the skin, e.g. in connection with a shaving procedure, comprising a refillable reservoir having at least one inlet and discharge port for filling the reservoir with water, for delivering into the reservoir a dose of a substance for mixture with water in the reservoir, and for discharging the liquid contents by pressure of gas within the reservoir, and a dose of substance for addition to the water and which upon mixing with the water generates gas and produces a prepared fluid for application to the skin, the reservoir being arranged for the gas generated by the dose of substance being mixed with water therein to pressurize the reservoir and to deliver the prepared fluid through the discharge port for application of the skin.

It is possible for a single port to provide the three functions of filling the reservoir with water, introducing the dose of substance and discharging the prepared fluid, or one port can serve for two of these functions while a second port serves for performance of the third. Alternatively, respective ports could be provided for filling with water, adding the substance, and discharging the fluid contents.

A valve means may be provided in a fluid discharge passage in order to control delivery of the prepared fluid from the reservoir. Conveniently prepared fluid is discharged by means of a dip tube extending into the reservoir and the dip tube can be equipped with a valve arrangement permitting discharge of the prepared fluid with the reservoir held either upright or in an inverted orientation.

The method and system for preparing a fluid according to the invention can be utilized advantageously in connection with a shaving procedure for preparing a fluid and delivering the fluid to the skin prior to, during or subsequent to actual shaving. The invention is especially convenient for delivery of a fluid which is applied to the skin by means of the razor itself, and in accordance with a further aspect the invention provides a razor comprising a shaving head including at least one blade, and a reservoir for supplying fluid to be applied to the skin during shaving, and a substance which on mixing with water generates a gas and produces the fluid to be applied to the skin, the reservoir being coupled to the shaving head and comprising a chamber refillable with water and at least one inlet and discharge port for filling the chamber with water, for delivering into the chamber the substance for mixing with water in the chamber to prepare the fluid to be applied to the skin, and for discharging the prepared fluid from the chamber for application to the skin, the fluid being discharged at or adjacent the shaving head under pressure produced in the chamber by the gas generated when the substance is mixed with the water in the chamber.

There have been previous proposals to include a pressurized container in a razor handle structure for dispensing shaving foam, examples of such constructions being those described in U.S. Pat. No. 5,337,478, WO-A-97/18065 and EP-A-0505630. The containers used in these razors are of the type which are pressurized in the factory at the time of manufacture. There have also been proposed razors in which liquid is discharged from a reservoir under gravity during shaving, examples of such razors being those described in U.S. Pat. No. 4,238,882, U.S. Pat No. 4,074,429 and GB-A-2266854. In GB-A-690828 there is disclosed a razor with a refillable reservoir which is pressurized by a piston actuated by a spring or a manually operated air pump and GB-A-2075406 describes a razor in which liquid is dispensed from a refillable container by operation of a fluid pump.

In a razor according to the present invention the fluid is preferably discharged at a position ahead of the blade or blades of the razor as they move across the skin during shaving, such as at the position of the guard of the shaving head which is disposed in advance of the blade or blades.

It is preferable that the substance be introduced into the reservoir as a predetermined dose and according to yet another aspect of the invention there is provided a container for preparing fluid for application to the skin in the course of performing a shaving procedure, comprising a refillable reservoir having an inlet for filling the reservoir with water, and a dispensing device for delivering a predetermined dose of substance into the water-filled reservoir, the dispensing device being arranged to hold a plurality of doses and being operable to deliver the doses into the reservoir in turn.

Such a container provides a very convenient way to prepare fluid for use during shaving, at the beginning of each shave the reservoir simply being refilled with water and the dispensing device being actuated to dispense the appropriate dose of substance into the water.

Most conveniently and preferably the substance is a solid and is supplied in predetermined doses in tablet or capsule form. In this case the container dispensing device may incorporate a magazine which is adapted to hold several tablets and to dispense the tablets one at a time into the reservoir for mixture with liquid therein.

The substance can be chosen so that when mixed with water it will 25 produce a fluid which can have a desired effect when applied to the skin in the course of a shaving procedure or in association with a shaving procedure. Thus, the prepared fluid may for example have one or more of the following effects:

(i) lubrication to help the razor slide over the skin;
(ii) moisturizing and/or otherwise conditioning the skin;
(iii) adding a fragrance;
(iv) chemically treating hairs to facilitate cutting;
(v) bacterial or medicinal treatment of the skin;
(vi) cleansing the skin; and
(vii) blood coagulation and/or other beneficial treatment of minor cuts and abrasions which can be suffered during shaving.

A gas generating substance can be included so that the substance, when mixed with water, will effervesce. The gas which is generated is preferably inert and carbon dioxide is most preferred as it is harmless and can be easily produced. The gas generator could for example be sodium bicarbonate which generates carbon dioxide gas when dissolved in water. The generation of carbon dioxide can, however, be accelerated by a chemical reaction involving neutralization of a carbonate salt by a weak acid, and the preferred gas generating substance is a mixture of dry solids comprising citric and/or tartaric acid with a carbonate salt including one or more selected from sodium carbonate, sodium bicarbonate, sodium hydrogen carbonate, potassium carbonate, potassium bicarbonate and potassium hydrogen carbonate. Other suitable gas generators will occur to those skilled in the art.

The substance which is mixed with water in the reservoir may be a solid substance, in which case it can conveniently be provided in tablet form, or as a powder contained within a soluble capsule. Alternatively, a substance other than a powder can be used and supplied for example, within a soluble capsule or in a sealed sachet from which the substance is discharged into the reservoir.

A better understanding of the invention in its different aspects will be gained from the more detailed description which follows and in which reference is made to the accompanying drawings, wherein.

Figure 1:
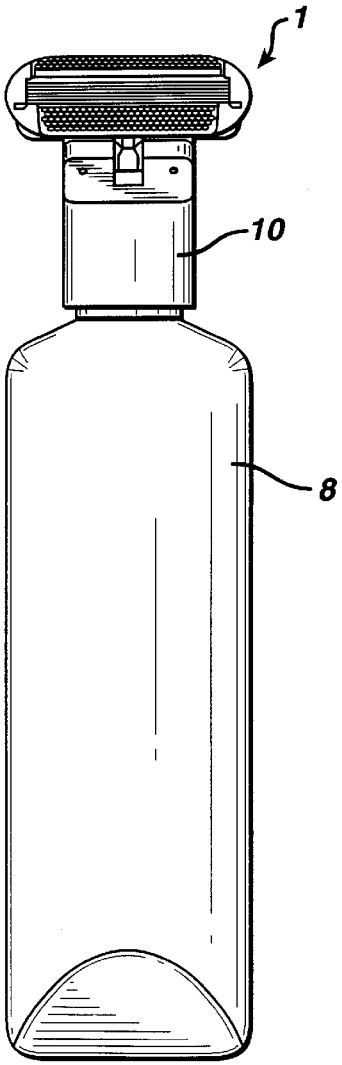
FIG. 1 is a front view of a razor according to the invention.
Figure 2:
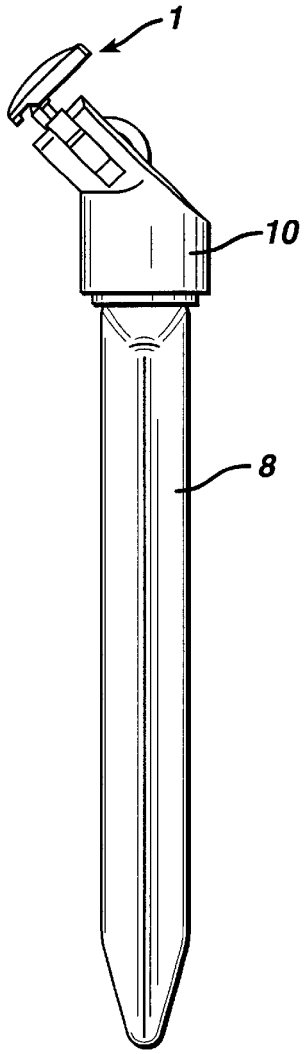
FIG. 2 is a side view of the razor shown in FIG. 1.
Figure 3:
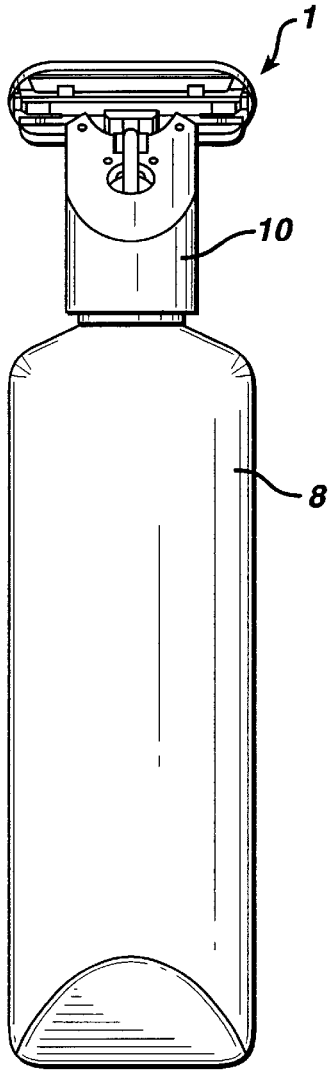
FIG. 3 shows the razor of FIG. 1 from the rear.

Referring initially to FIGS. 1 to 7 there is shown a razor having a shaving head or blade unit 1 including three blades 2 with parallel cutting edges carried within a frame 3 which also supports guard and cap structures 4,5 defined by elastomeric strips which are each shown to have an array of close-packed cylindrical recesses 6, although other configurations of recesses and/or projections could be provided instead as known in the art. For further details of the elastomeric strips 4,5 and the recesses 6 therein reference can be made to WO96/02369, WO97/17174, the contents of which are incorporated herein by reference. The cap structure 5 incudes a lubricating strip 12 as known per se and which may be as described in U.S. Pat. No. 5,113,585, the contents of which are incorporated herein by reference. The blades 2 can be movable independently of each other against the action of return springs under the forces experienced by the blades during shaving as also known in the art. Further details of spring loaded blades may be found in U.S. Pat. No. 4,492,025 the contents of which are also incorporated herein by reference. Alternatively, the blades 2 can be fixedly mounted in the frame. The shaving head 1 may be fixedly attached to the remaining parts of the razor with the intention that at least the upper part of the razor be discarded in entirety when the blades 2 have become dulled, or the shaving head 1 could be of the replaceable cartridge type so that the shaving head is merely replaced when the blades 2 have lost their sharpness.

Figure 4:
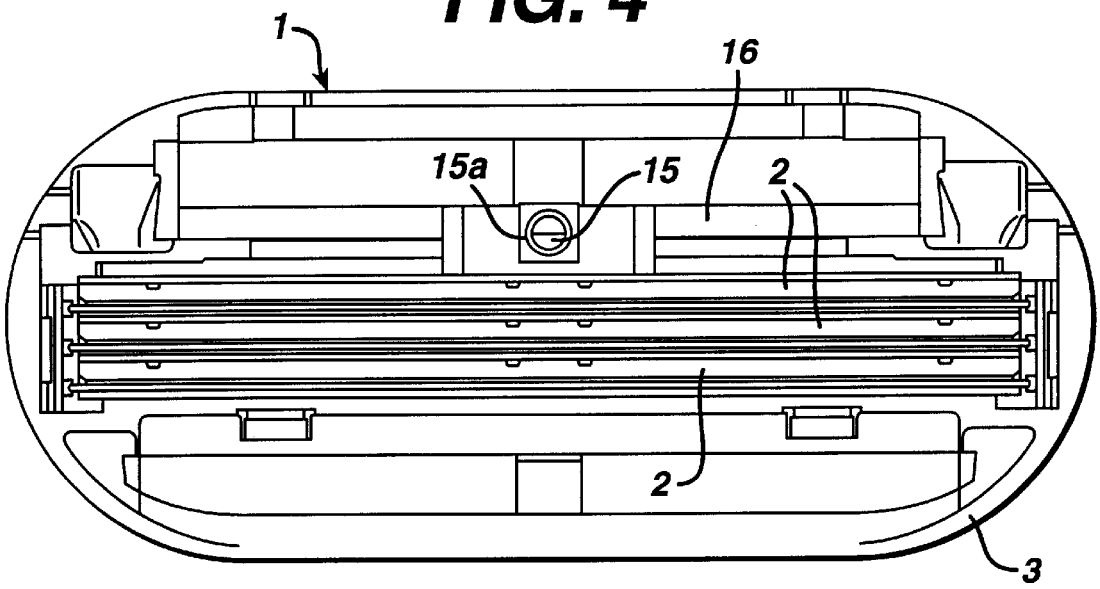
FIG. 4 is an enlarged underside view of the shaving head of the razor shown in FIG. 1.
Figure 5:
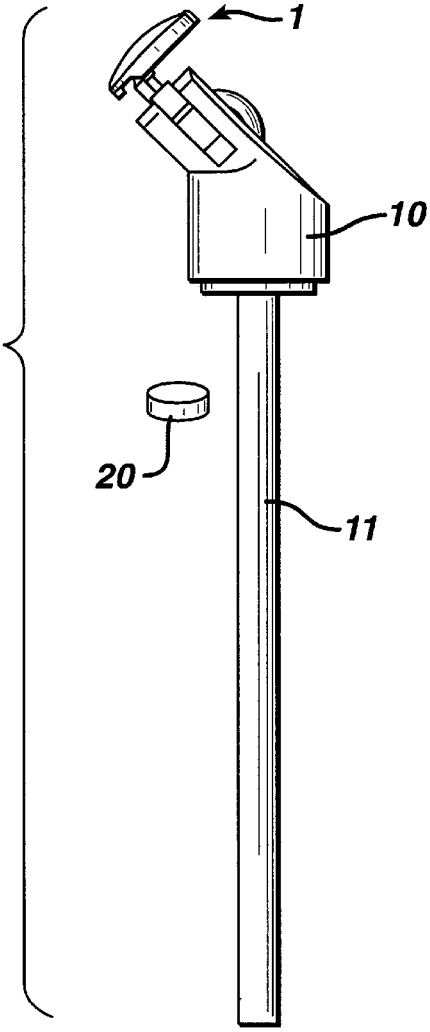
FIG. 5 is a side view of the razor of FIG. 1 with the reservoir container removed.
Figure 6:
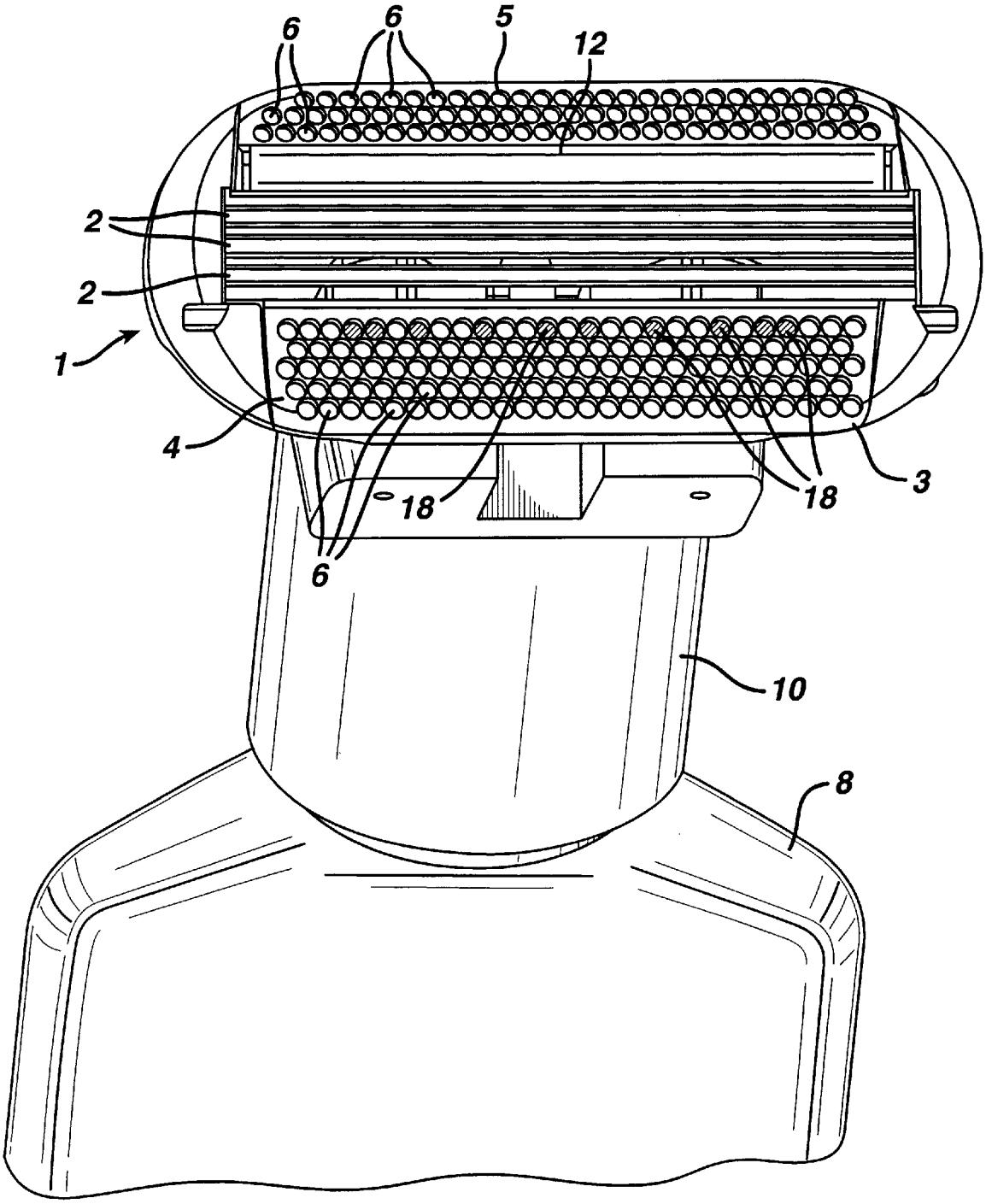
FIG. 6 is an enlarged perspective view showing an upper part of the razor of FIG. 1.
Figure 7:
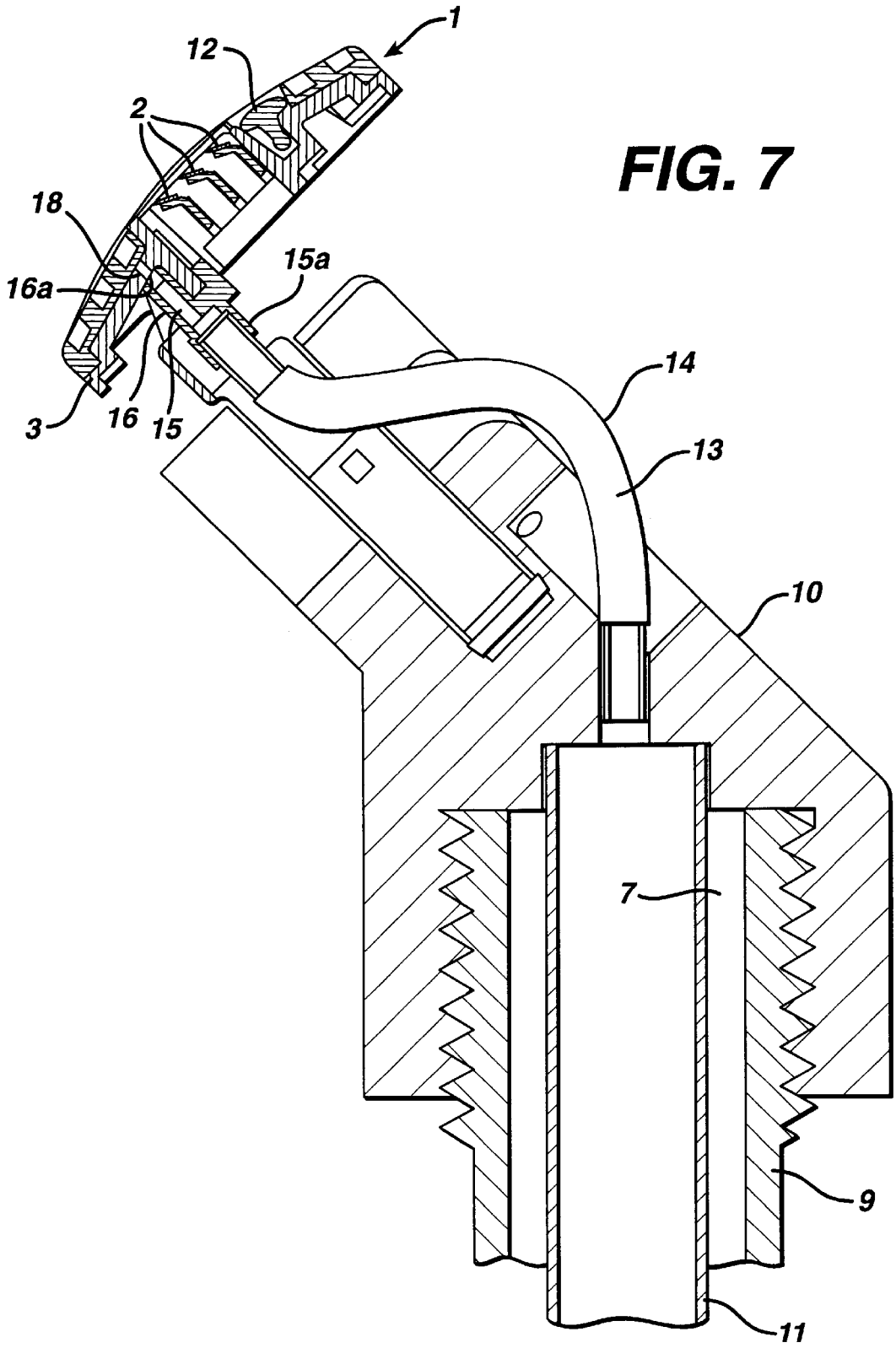
FIG. 7 is a cross-section through the upper part of the razor of FIG. 1.
Figure 7A:
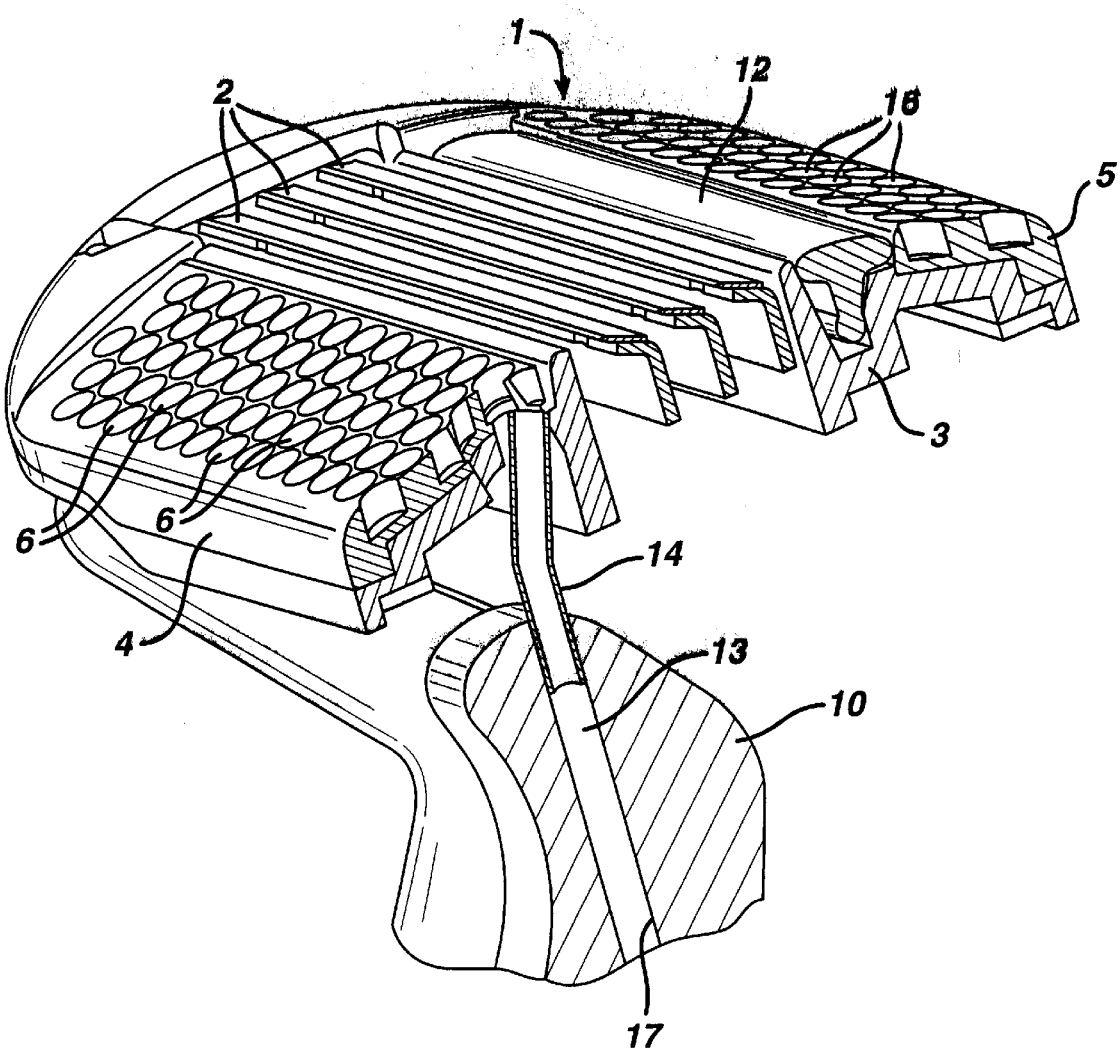
FIG. 7A is a sectioned perspective view showing a modification to the razor neck and cartridge of the embodiment illustrated in FIG. 7.

The razor includes a refillable reservoir in the form of a container 8 which doubles as the razor handle, this container having a generally flat rectangular form enclosing an interior chamber with an inlet/discharge port 7 defined by a neck 9 (FIG. 7) located at the upper end of the reservoir container and by means of which the container is detachably connected, such as by a screw threaded or bayonet type coupling, to a razor neck 10. A lower part of the razor neck 10 forms a cap for co-operation with the container neck 9, and the upper part of the razor neck carries the shaving head 1. The razor neck 10 is equipped with an elongate dip tube 11 (FIGS. 5 and 7) which is arranged to extend down through the container neck 9 and substantially to the bottom of the container 8 when it is coupled to the razor neck 10. Further details of the dip tube are described below with reference to FIGS. 8 and 9. The upper end of the dip tube 11 communicates with a fluid delivery passage 13 which in the embodiment illustrated in FIG. 7 is formed by a tube 14, but in the modified embodiment shown in FIG. 7A a bore 17 through the razor neck 10 defines part of the fluid delivery passage. The downstream end of the delivery passage 13 is connected to an inlet duct 15 in the shaving head. The inlet duct 15 is formed in a manifold member 16 which is attached to the underside of the frame 3 of the shaving head 1 and includes a socket 15*a* to which the end of the tube 14 is fitted and with which the duct 15 communicates. The manifold member 16 extends along the underside of the guard 4, parallel with the blades and adjacent the trailing edge of the guard surface, as can be seen in FIG. 4. The delivery manifold 16 defines an interior channel 16*a* and has spaced along its length a series of holes which are aligned with openings 18 in the guard surface. Thus, it will be understood that fluid in the container 1 can be delivered, by means of the dip tube 11, the delivery passage 13, the delivery manifold 16, and the openings 18 to the guard surface, it being the intention that such delivery should occur during the process of shaving with the razor. In the modified construction of FIG. 7A, the delivery tube opens into one of the recesses 6 of the guard strip 5 and in this case there is no manifold member, the tube 14 being connected to an opening in the guard structure.

At the beginning of a shaving procedure, the container 8 is disconnected from the razor neck 10 and is filled with water to a depth that may be indicated by an appropriate marking on the container. A tablet 20 (FIG. 5) of a solid substance which on contact with water effervesces to generate gas, preferably carbon dioxide and with the water forms a fluid having a characteristic which makes it desirable for application to the skin during shaving, is dropped into the container 8 through the neck 9, and the container is then immediately reconnected to the razor neck 10. The preferred gas generating substance comprises a mixture of tartaric acid and/or citric acid with a carbonate, bicarbonate or hydrogen carbonate salt of sodium or potassium. The gas generated by the reaction of the tablet substance with the water causes the pressure within the ullage space above the water in the container to rise, and this pressure forces the prepared fluid produced by the solid substance mixing with the water to flow through the dip tube 11 and to the shaving head following the flow path previously described. The amounts of gas generated and fluid prepared are sufficient for continuous delivery to take place for the time taken to complete a shave with the razor, although it will be appreciated that the amounts of carbon dioxide generating substance will depend on the volume of the container 8 and the amount of water it is intended to be filled with. In one test, however, a container having a capacity of 40 ml was filled with 30 ml of water. Two tablets each weighing 0.3 g were added to the water, the composition of each tablet being:

| | |
|---|---|
| Sodium hydrogen carbonate | 44 wt % |
| Citric Acid | 36 wt % |
| Xanthum Gum | 15 wt % |
| Polyox (lubricant) | 5 wt % |

The maximum pressure generated in the container which was fitted with a 5 mm bore ball valve in the dip tube, was 0.6 psi (4.1 kPa) and this pressure produced an average maximum flow rate of 4.5 ml/min, and continuous flow of liquid from the container lasted for an average of about 7 minutes.

It will be understood the procedure of filling the container 8 and adding a tablet 20 will be repeated for each shave. If desired the delivery passage could be fitted with a valve to allow the user to control the time of delivery and/or the rate of delivery of prepared fluid to the shaving head 1.

Figure 8:
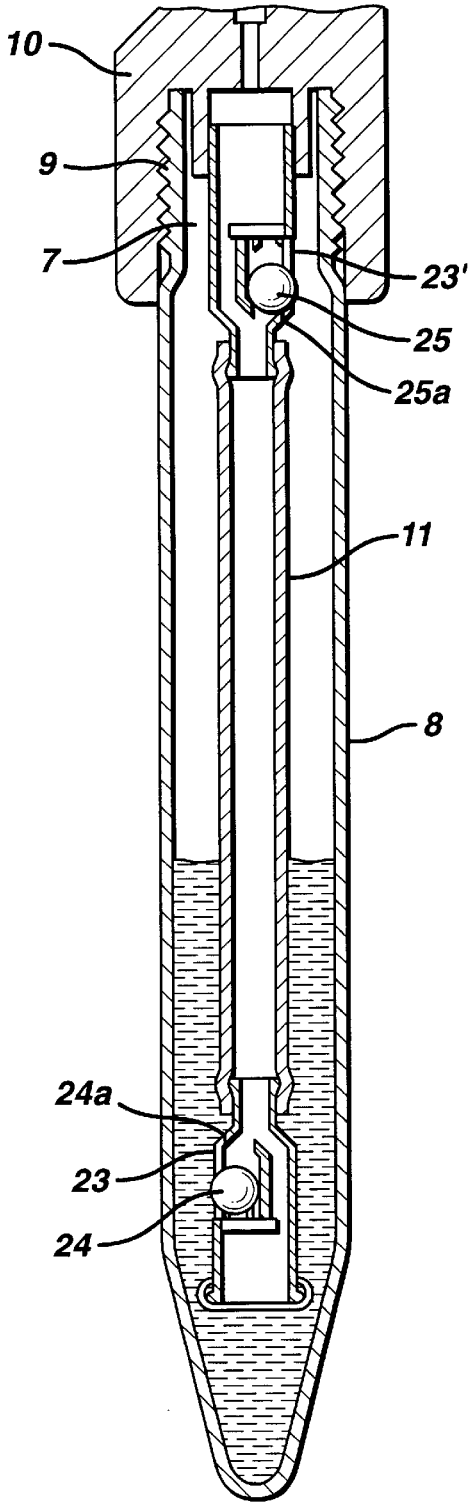
FIGS. 8 and 9 are cross-sections illustrating the dip tube valve system in upright and inverted orientations, respectively.
Figure 9:
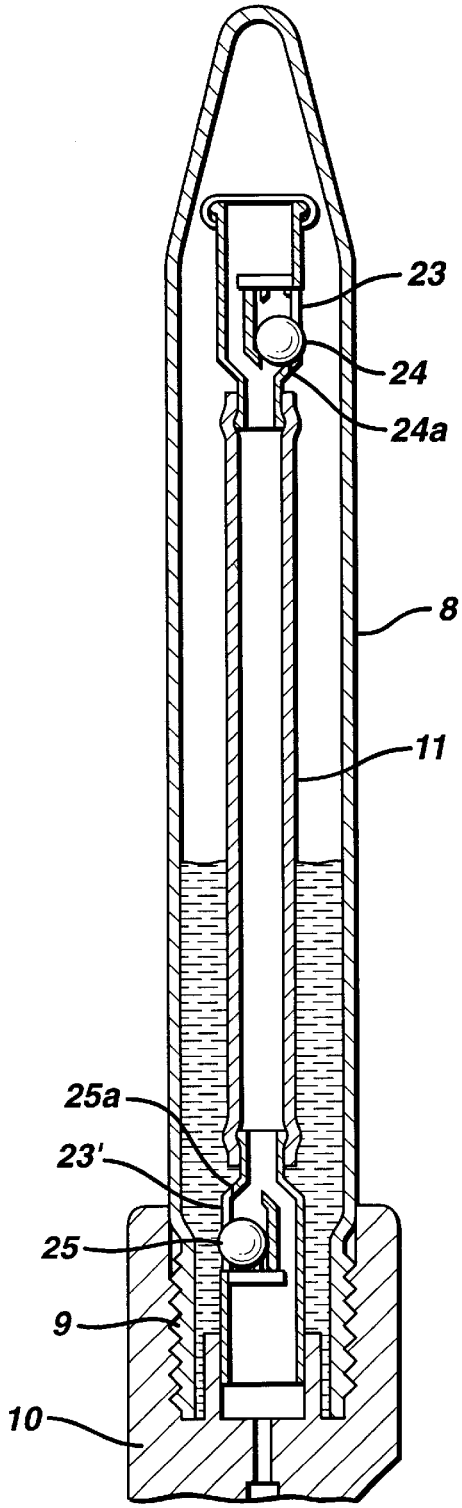

As razors are sometimes held other than upright during shaving the dip tube 11 preferable incorporates a valve arrangement to ensure that prepared fluid is always discharged by the gas pressure. As shown in FIGS. 8 and 9, the dip tube 11 has openings 23, 23' adjacent its opposite ends for connecting the inside of the tube with the interior of the container, these openings being controlled by respective ball valves 24, 25. Each of the valves is gravity operated with the ball 24, 25 moving under its own weight between open an closed positions as the container is rotated between upright and inverted orientations. When the container is upright (FIG. 8) the lower valve 24 is open due to its ball having moved away from the valve seat 24*a* and the upper valve 25 is closed, due to its ball engaging the valve seat 25*a* and being held against the seat by the pressure in the container. When the container is inverted (FIG. 9), the valve 25 is opened and the valve 24 is closed. Thus, in both orientations that dip tube opening 23 or 23' which is opened for flow of fluid into the dip tube 11 is always immersed in the fluid within the container 8.

Figure 10:
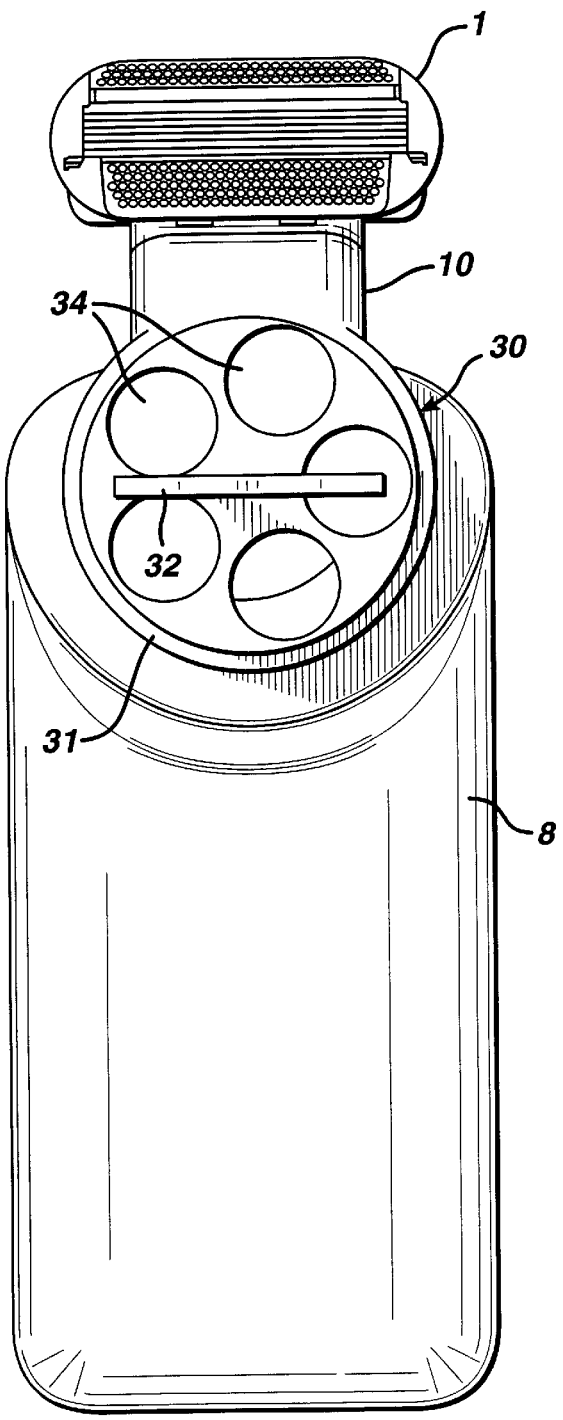
FIG. 10 is a front view showing a modified razor including a tablet dispenser.
Figure 11:
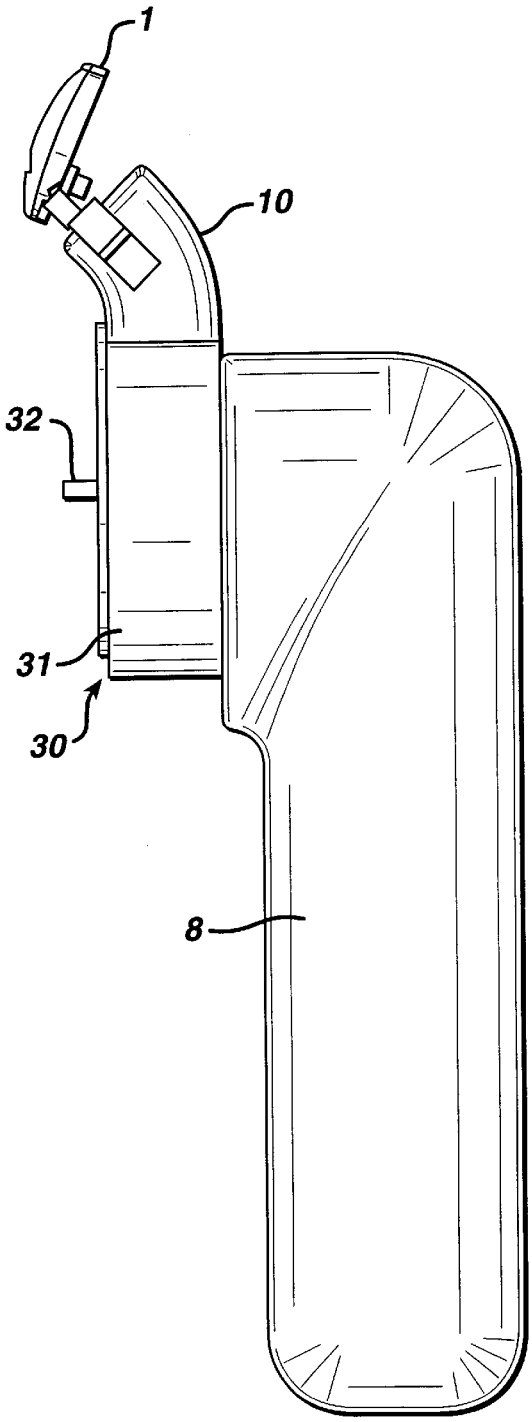
FIG. 11 is a side view of the razor of FIG. 10.
Figure 12:
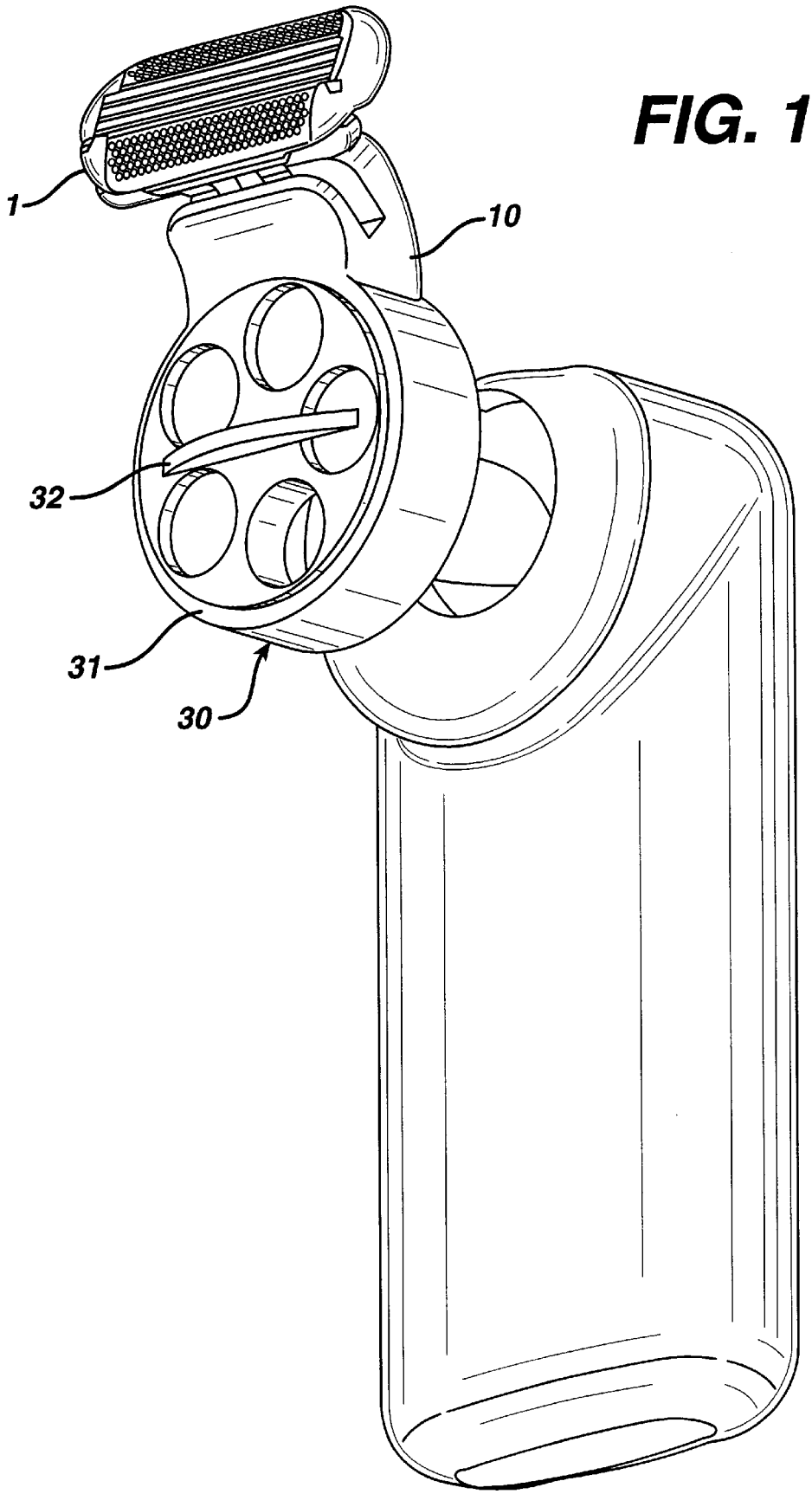
FIG. 12 shows the razor of FIG. 10 in perspective and which the upper part partially removed for filling the reservoir container with water.

In FIGS. 10–12 there is illustrated a modified razor which is generally similar to that described above but differs in that the razor neck 10 incorporates a tablet magazine and dispenser 30. The shape of the container 8 is adapted to define a forwardly facing neck opening or port to which the lower part of the razor neck 10 is detachably connectable by any suitable means capable of establishing a sealed connection between the razor neck 10 and the container 8. The lower portion of the razor neck 10 incorporates the tablet magazine and dispenser 30 which includes a cylindrical housing 31 within which there is received a rotary member 32 defining a series of pockets 34, five in number as shown, distributed in a circular array and intended to receive respective tablets of solid substance to be mixed with water within the container 8. A detent system is preferably provided to provide some control over the rotation of the member 32 whereby the pockets 34 are easily presented in turn in position to dispense the tablets contained therein into the container interior. The tablet magazine can be rechargeable to allow the pockets to be refilled with tablets after they have been emptied, or the rotary member could be replaceable to allow an emptied member 32 to be replaced by a similar but fully charged one. Alternatively, the magazine may be adapted to hold a sufficient number of tablets for a number of shaves that the blades of the razor are expected to last for before becoming dulled, and the magazine and razor cartridge may then be discarded and replaced together, possibly as a single unit or a cartridge and magazine assembly.

In use of the razor of FIGS. 10–12, the container 8 is detached from the razor neck 10 and filled to a certain level with water, after which the container 8 and razor neck are reconnected. The rotary member 32 is then turned manually to bring a pocket 34 containing a tablet to a rotational dispensing position whereat the tablet 20 is deposited from the pocket into the container where it mixes with the water for generating gas and producing a prepared fluid to be delivered to the shaving head 1. The fluid is conducted to the guard surface of the shaving head in the same way as described above with respect to the embodiment of FIGS. 1–9, namely through the dip tube, the delivery passage included in the razor neck, the delivery manifold provided in the shaving head, and the openings 18 at the guard surface. It will be appreciated that the tablet magazine and dispenser is shown only schematically and it would be arranged so that the container is sealed closed after delivering a tablet into the container, which is necessary to create the gas pressure needed for discharging the prepared fluid in the reservoir container.

Modifications are of course possible to the specific embodiments described above without departing from the scope of the invention as defined by the claims which follow. By way of example, a valve could be included in the fluid passage 13 between the container 8 and shaving head 1 to allow the user to control when and/or the rate at which fluid is to be supplied to the shaving head. Also, a tablet system for preparing and dispensing a prepared fluid onto the skin in the course of a shaving procedure could be provided independently of a razor if desired. A container and supply of tablets can have the advantage of being much smaller and lighter in weight than conventional shave preparation dispensers.

What is claimed is:

1. A shaving system, which comprises a razor comprising a shaving head including at least one blade, a refillable reservoir for supplying a fluid to be applied to the skin in connection with a shaving procedure, and a dose of a substance which on mixing with water generates gas and produces a prepared fluid having a characteristic desirable for treating the skin and/or the hair to be shaved, the reservoir being coupled to the shaving head and comprising a chamber including at least one inlet and discharge port for filling the chamber with water, for delivering into the chamber the substance for mixture with water in the chamber, and for discharging the prepared fluid from the chamber for application to the skin, the prepared fluid being discharged at the shaving head under pressure produced in the chamber by the gas generated when the substance is mixed with the water in the chamber, the reservoir comprising a container arranged to form a razor handle, the shaving head being detachably supported on the container by a razor neck providing a delivery passage for conducting the prepared fluid discharged from the reservoir chamber to the shaving head, and the razor neck providing a cap which can be detached from the container to allow the water and the substance to be added to the chamber to form the prepared fluid therein, said dose having a predetermined amount of said substance such that the amounts of gas generated and fluid prepared are sufficient for delivery to the skin to complete only one shave.

2. A shaving system according to claim 1, wherein the shaving head is arranged for the prepared fluid to be discharged at a position ahead of the blade or blades as they move across the skin during shaving.

3. A shaving system according to claim 2, wherein the prepared fluid is discharged at a guard surface.

4. A razor according to claim 1, wherein means are provided for delivering a predetermined dose of the substance into the container.

5. A razor according to claim 1, wherein a predetermined dose of the substance is provided in tablet form or contained in a water soluble capsule.

6. A razor according to claim 1, including a magazine for holding respective doses of substance and operable to deliver the respective doses in turn into the reservoir chamber.

7. A shaving system according to claim 1, wherein the substance generates carbon dioxide on being mixed with water.

8. A shaving system according to claim 7, wherein the substance comprises sodium bicarbonate.

9. A shaving system according to claim 7, wherein the substance comprises tartaric acid and/or citric acid and at least one salt selected from the group consisting of sodium carbonate, sodium bicarbonate, sodium hydrogen carbonate, potassium carbonate, potassium bicarbonate, and potassium hydrogen carbonate.

10. The razor according to claim 1, wherein a valve means is provided for controlling flow of fluid through the delivery passage through which fluid flows from the reservoir to the shaving head.

11. A shaving system, which comprises a razor comprising a shaving head including at least one blade, a refillable reservoir for receiving water and supplying a fluid to be applied to the skin in connection with a shaving procedure, and a dose of a substance for addition to the water in the reservoir for generating gas and producing a prepared fluid having a characteristic desirable for treating the skin and/or the hair to be shaved, the reservoir being coupled to the shaving head and comprising a chamber including at least one inlet and discharge port for filling the chamber with water, for delivering into the chamber the dose of the substance for mixture with water in the chamber, and for discharging the prepared fluid from the chamber for application to the skin, the prepared fluid being discharged at the shaving head under pressure produced in the chamber by the gas generated when the substance is mixed with the water in the chamber, said dose having a predetermined amount of said substance such that the amounts of gas generated and fluid prepared are sufficient for delivery to the skin to complete only one shave.

12. A shaving system according to claim 11, wherein the reservoir comprises a container arranged to form a razor handle, and the shaving head is detachably supported on the container by a razor neck providing a delivery passage for conducting fluid discharged from the reservoir chamber to the shaving head.

13. A shaving system according to claim 12, wherein the container includes a container neck which defines a combined inlet and discharge port and the razor neck is detachably connected to the container neck.

14. A shaving system according to claim 13, wherein the razor neck forms a cap which is detachable from the container neck to allow the water and the dose of the substance to be added to the container.

15. A shaving system according to claim 13, wherein the container neck and the razor neck are provided with a screw threaded coupling to detachably connect the container neck to the razor neck.

16. A shaving system according to claim 14, which includes a dip tube in communication with the fluid delivery passage for discharge of fluid from the reservoir, the dip tube having a valve arrangement permitting discharge of fluid therethrough with the reservoir held either upright or inverted.

17. A shaving system according to claim 16, wherein the valve arrangement comprises a first valve adjacent to the lower end of the dip tube and a second valve adjacent to the upper end of the dip tube for controlling the flow of fluid from the container into the dip tube, the first valve being open and the second valve being closed when the container is upright, and the first valve being closed and the second valve being open when the container is inverted.

18. A shaving system according to claim 17, wherein each valve comprises a gravity operated ball valve.

19. A shaving system according to claim 16, which includes a tube extending from the delivery passage in the razor neck to the shaving head.

20. The shaving system of claim 11, wherein the substance on admixture with water produces a fluid with desired lubricating properties and/or moisturizing properties and/or fragrance and/or chemical hair treatment properties and/or bacterial or medicinal properties, and/or cleansing properties and/or blood coagulation properties.

* * * * *

UNITED STATES PATENT AND TRADEMARK OFFICE

CERTIFICATE OF CORRECTION

PATENT NO. : 6,754,958 B2
DATED : June 29, 2004
INVENTOR(S) : Christopher Martin Haws et al.

It is certified that error appears in the above-identified patent and that said Letters Patent is hereby corrected as shown below:

Column 8,
Line 21, change "claim 13" to -- claim 14 --.

Signed and Sealed this

Fifth Day of October, 2004

JON W. DUDAS
*Director of the United States Patent and Trademark Office*